US011331246B2

(12) United States Patent
Stout et al.

(10) Patent No.: US 11,331,246 B2
(45) **Date of Patent: *May 17, 2022**

(54) HEATED AIR BATH SYSTEM

(71) Applicant: KOHLER CO., Kohler, WI (US)

(72) Inventors: Kenneth Stout, Sheboygan Falls, WI (US); Craig Loest, Kohler, WI (US); Jason Kwacz, Kohler, WI (US)

(73) Assignee: KOHLER CO., Kohler, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/931,119

(22) Filed: May 13, 2020

(65) Prior Publication Data

US 2020/0297578 A1 Sep. 24, 2020

Related U.S. Application Data

(63) Continuation of application No. 15/949,652, filed on Apr. 10, 2018, now Pat. No. 10,675,214.

(60) Provisional application No. 62/545,588, filed on Aug. 15, 2017.

(51) Int. Cl.

| | |
|---|---|
| ***A61H 33/00*** | (2006.01) |
| ***A61H 33/02*** | (2006.01) |
| ***A61H 1/00*** | (2006.01) |

(52) U.S. Cl.

CPC ..... *A61H 33/6063* (2013.01); *A61H 1/00* (2013.01); *A61H 33/005* (2013.01); *A61H 33/02* (2013.01); *A61H 33/026* (2013.01); *A61H 33/027* (2013.01); *A61H 33/028* (2013.01); *A61H 2033/0054* (2013.01);

(Continued)

(58) Field of Classification Search

CPC ..... A61H 33/6063

USPC ..... 4/541.1–541.4

See application file for complete search history.

(56) References Cited

U.S. PATENT DOCUMENTS

| | | | |
|---|---|---|---|
| 433,490 | A | 8/1890 | Reilly |
| 520,880 | A | 6/1894 | Gwynn et al. |
| 3,207,133 | A | 9/1965 | Andersen |

(Continued)

FOREIGN PATENT DOCUMENTS

| | | |
|---|---|---|
| CN | 203518235 | 4/2014 |
| CN | 106026909 | 10/2016 |

(Continued)

OTHER PUBLICATIONS

Chinese Second Office Action on CN Application No. 201810374929.9 dated Feb. 9, 2021.

CN First Office Action dated Jul. 16, 2020 12 pages.

*Primary Examiner* — Christine J Skubinna

(74) *Attorney, Agent, or Firm* — Foley & Lardner LLP

(57) ABSTRACT

A bath system comprises a tub and a fluid injection system. The tub has a jet orifice, and the fluid injection system is fluidly coupled to the jet orifice. The fluid injection system comprises a conduit, a heat source, an air supply source, and a fluid injector. The conduit has an opening. The heat source is coupled to an outer portion of the conduit external to the opening. The air supply source is fluidly coupled to the conduit, and is configured to provide a flow of air to the central opening. The fluid injector is configured to provide water to the flow of air to produce a combined flow of air and water. The heat source and the conduit are cooperatively configured to heat the combined flow of air and water in the opening before the combined flow enters the tub through the jet orifice.

22 Claims, 9 Drawing Sheets

(52) U.S. Cl.
CPC ..... *A61H 2201/0228* (2013.01); *A61H 2201/1207* (2013.01); *A61H 2201/50* (2013.01); *A61H 2201/5082* (2013.01)

(56) References Cited

U.S. PATENT DOCUMENTS

| | | | |
|---|---|---|---|
| 3,417,747 | A | 12/1968 | Beger |
| 3,571,818 | A | 3/1971 | Jacuzzi |
| 3,842,446 | A | 10/1974 | Hunhausen et al. |
| 4,008,498 | A | 2/1977 | Thomas |
| 4,130,120 | A | 12/1978 | Kohler, Jr. |
| 4,249,522 | A | 2/1981 | Carrier |
| 4,264,039 | A | 4/1981 | Moreland |
| 4,754,502 | A | 7/1988 | Bowen |
| 4,833,739 | A | 5/1989 | Sakakibara et al. |
| 4,858,255 | A | 8/1989 | Haisman |
| 4,859,345 | A | 8/1989 | Inagaki |
| 4,899,401 | A | 2/1990 | Savarese |
| 5,381,957 | A | 1/1995 | Bianco |
| 5,930,851 | A | 8/1999 | Brunelle |
| 6,317,903 | B1 | 11/2001 | Brunelle et al. |
| 6,772,455 | B2 | 8/2004 | Takahata et al. |
| 6,943,325 | B2 | 9/2005 | Pittman et al. |
| 7,334,274 | B2 | 2/2008 | Wang |
| 7,775,457 | B2 | 8/2010 | Schnuckle |
| 8,984,678 | B2 | 3/2015 | Brunelle et al. |
| 9,410,652 | B2 | 8/2016 | Ellis et al. |
| 9,487,350 | B2 | 11/2016 | Sivan et al. |
| 2002/0050490 | A1 | 5/2002 | Pittman et al. |
| 2008/0072375 | A1 | 3/2008 | Stewart |
| 2008/0172783 | A1 | 7/2008 | Smith et al. |
| 2010/0223721 | A1* | 9/2010 | May ..... A61H 33/005 4/541.1 |
| 2011/0283448 | A1 | 11/2011 | Kenoyer et al. |
| 2013/0000031 | A1 | 1/2013 | Brunelle et al. |
| 2013/0305448 | A1 | 11/2013 | Nguyen |
| 2014/0059759 | A1 | 3/2014 | Duhack et al. |
| 2019/0099325 | A1 | 4/2019 | Ovalle |
| 2019/0254485 | A1 | 8/2019 | Stout |

FOREIGN PATENT DOCUMENTS

| | | |
|---|---|---|
| JP | 40-4253861 | 9/1992 |
| RU | 2561292 | 8/2015 |

* cited by examiner

HEATED AIR BATH SYSTEM

CROSS-REFERENCE TO RELATED PATENT APPLICATIONS

This application is a Continuation of U.S. patent application Ser. No. 15/949,652, filed Apr. 10, 2018, which claims the benefit of and priority to U.S. Provisional Application No. 62/545,588, filed Aug. 15, 2017. The entire disclosures of the foregoing U.S. applications are hereby incorporated by reference herein.

BACKGROUND

The present application relates generally to bath systems. More specifically, the present application relates to a jetted air bath system, sometimes referred to as a "bubble-massaging" bath system.

Generally speaking, most conventional air bath systems include a tub and an air injection system coupled to the tub. The air injection system can introduce air into the tub via one or more orifices to create bubbles within the tub and provide a massaging effect on a user's body (i.e., a bubble-massaging effect).

SUMMARY

An embodiment of the present application relates to a bath system. The bath system comprises a tub and a fluid injection system. The tub has a jet orifice, and the fluid injection system is fluidly coupled to the jet orifice. The fluid injection system comprises a conduit, a heat source, an air supply source, and a fluid injector. The conduit has a central opening. The heat source is coupled to an outer portion of the conduit external to the central opening. The air supply source is fluidly coupled to the conduit, and is configured to provide a flow of air to the central opening. The fluid injector is configured to provide an atomized spray of water to the flow of air to produce a combined flow of air and water. The heat source and the conduit are cooperatively configured to heat the combined flow of air and water in the central opening before the combined flow enters the tub through the jet orifice.

Another embodiment relates to a bath system. The bath system comprises a tub and a fluid injection system. The tub has a jet orifice, and the fluid injection system is fluidly coupled to the jet orifice. The fluid injection system comprises a conduit, a heat source, an air supply source, and a fluid injector. The conduit has an inlet, an outlet, and a central opening between the inlet and the outlet. The heat source is coupled to an outer portion of the conduit external to the central opening. The air supply source is fluidly coupled to the conduit upstream from the inlet, and is configured to provide a flow of air to the central opening. The fluid injector is fluidly coupled to the conduit upstream from the inlet and downstream from the air supply source, and is configured to provide an atomized spray of water to the flow of air to produce a combined flow of air and water. The heat source and the conduit are cooperatively configured to heat a combined flow of air and water in the central opening before the combined flow enters the tub through the jet orifice.

Another embodiment relates to a fluid injection system for a bathtub. The fluid injection system comprises a conduit, a heat source, an air supply source, and a fluid injector. The conduit has a central opening. The heat source is coupled to an outer portion of the conduit external to the central opening. The air supply source is fluidly coupled to the conduit, and is configured to provide a flow of air to the central opening. The fluid injector is configured to provide an atomized spray of water to the flow of air to produce a combined flow of air and water. The heat source and the conduit are cooperatively configured to heat the combined flow of air and water in the central opening before the combined flow enters a bathtub to produce bubbles.

Another embodiment relates to a hydro-massaging bath system comprising a tub and an air/water injection system fluidly coupled to the tub at one or more air injection orifices. The air/water injection system comprises a conduit, a heat source, an air supply source, and a nozzle. The conduit includes a central opening defined by an inner wall which may include a plurality of fins extending inward from the inner wall. The heat source is coupled to an outer wall of the conduit external to the central opening, and is configured to provide heat energy to the conduit via conduction through the inner wall of the conduit. The air source is fluidly coupled to the conduit and is configured to provide a flow of air to the central opening. The nozzle is positioned upstream of the conduit, and is configured to provide an atomized spray of water to the flow of air prior to entering the conduit. The heat source and the conduit are configured to heat the combined flow of air and water before being introduced into the tub through the one or more air injection orifices.

DETAILED DESCRIPTION

Generally speaking, the bubbles created in most conventional air bath systems can have a chilling effect on a user due to the evaporative cooling effect of warm dry air coming into contact with the user's wet skin, which can be undesirable. Furthermore, the water contained in conventional air bath systems typically cools very quickly (e.g., approximately 5 degrees over 20 minutes, etc.), because of the evaporative cooling effect of the bubbles, which is also undesirable.

Referring generally to the FIGURES, disclosed herein are various embodiments of a bath system including a fluid injection system (e.g., an air/water injection system, etc.) that heats a mixed flow of air and water together prior to entering the tub, so as to reduce or eliminate the chilling effect experienced by a user and to maintain a desired temperature of the water contained within the tub. According to an exemplary embodiment, water is combined with a flow of air prior to entering a conduit by, for example, a fluid injector. The mixed flow of air and water is then heated by a heat source located external to the interior of the conduit, such as one or more heating elements coupled to an outer portion of the conduit. Heat energy from the external heat source can be transferred via conduction through the outer portion of the conduit to an interior of the conduit via structural features of the conduit wall, such as one or more fins extending inwardly from the wall of the conduit. The heat energy can be transferred to the mixed flow of air and water flowing through the conduit before being introduced into the tub via one or more jet orifices located on the tub. In this manner, the disclosed system can help to maintain an elevated temperature of the water contained in the tub, and can help to reduce or eliminate the chilling effect experienced by users of conventional air bath systems. Furthermore, by locating the heat source external to the interior of the conduit, away from direct contact with the air/water mixture flowing in the conduit, large temperature variations in the heat source can be reduced or eliminated, thereby increasing the effectiveness and extending the useful life of the heat source.

Figure 1:
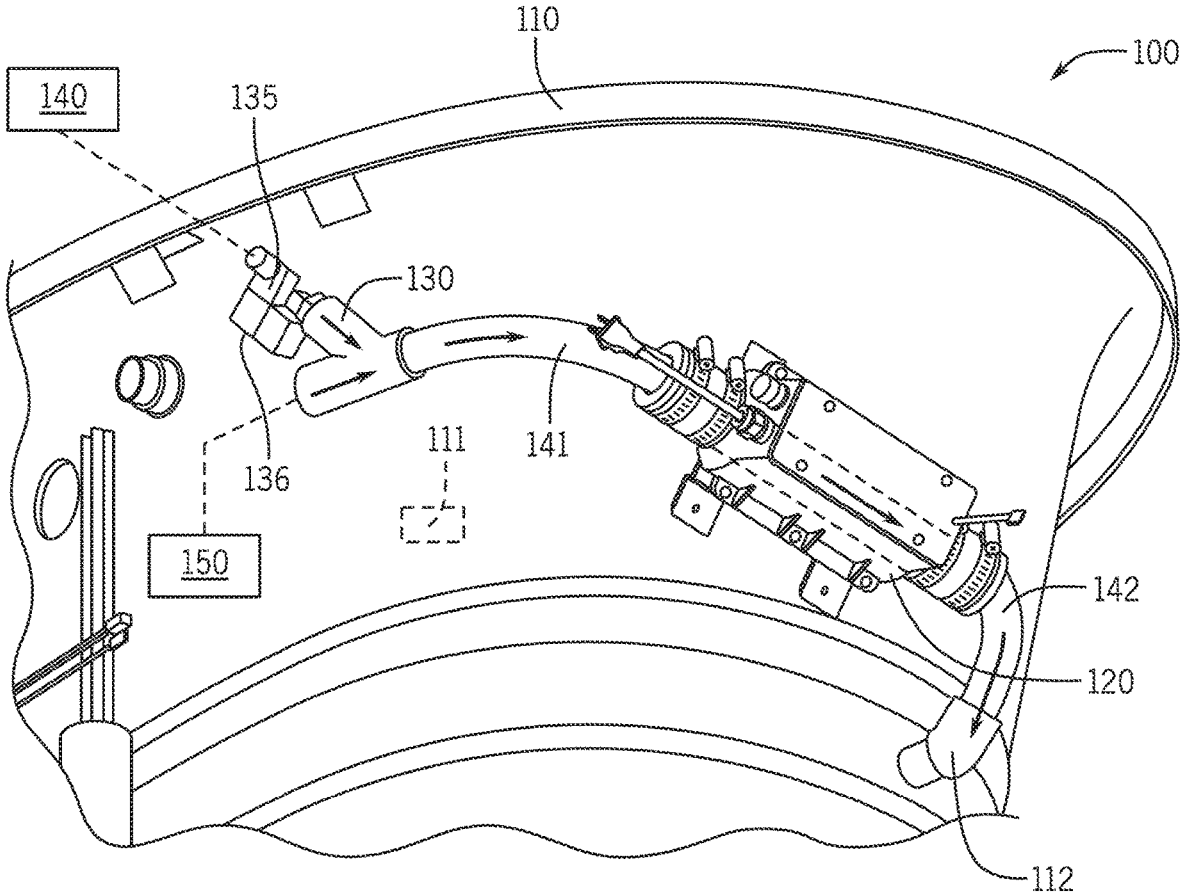
FIG. 1 is a partial perspective view of a bath system according to an exemplary embodiment.
Figure 2:
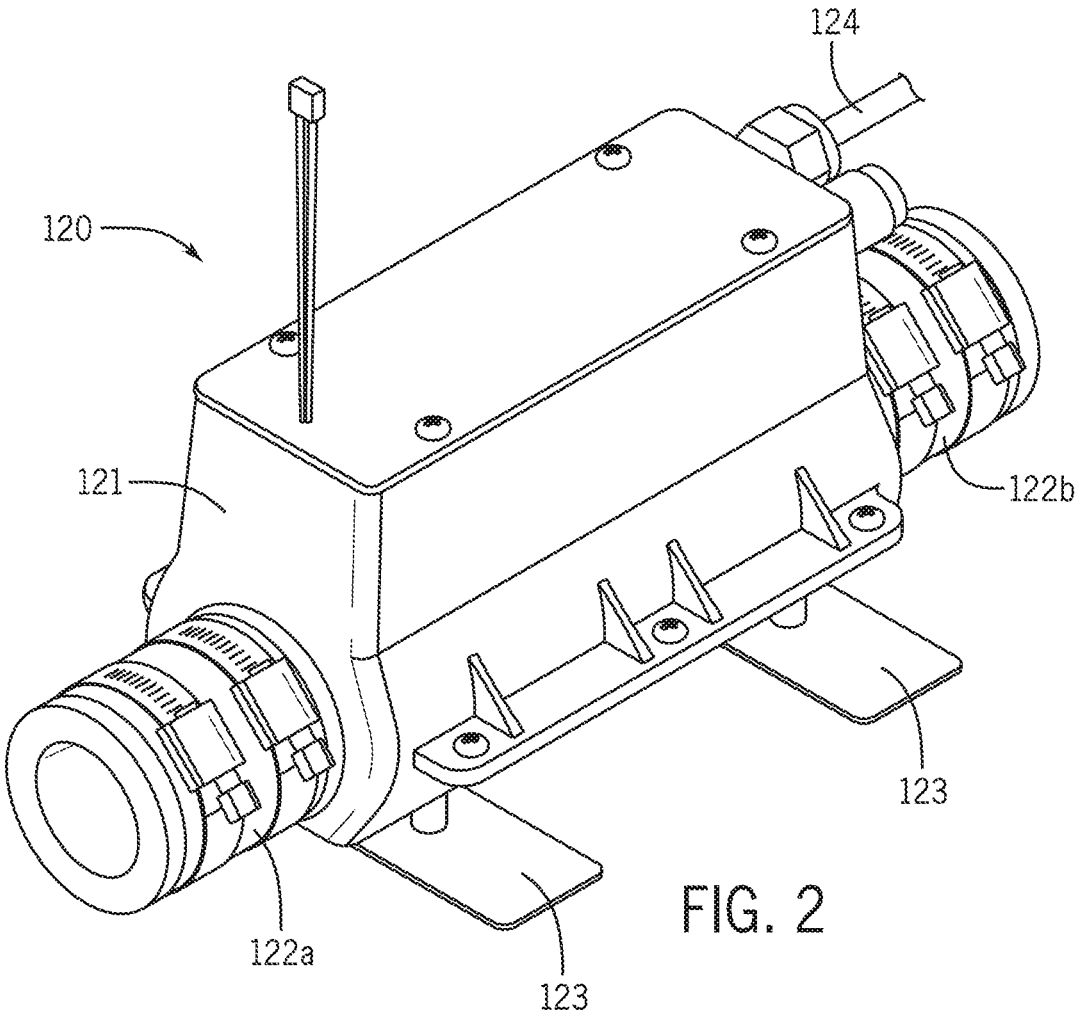
FIG. 2 is a perspective view of a conduit assembly according to an exemplary embodiment.

Referring to FIG. 1, an air bath system 100 is shown according to an exemplary embodiment. The air bath system 100 includes a tub 110 (e.g., vessel, bathtub, etc.) including an air inlet 112 for distributing air to a plurality of air injection orifices (e.g., jet orifices, etc.) located throughout the tub, such as along the sidewalls and/or along the bottom wall of the tub. A fluid injection system defined in part by a conduit assembly 120, a fitting 130, a fluid injector 135 (e.g., atomizer, sprayer, misting nozzle, etc.), and a plurality of conduit sections 141, 142, is fluidly coupled to the tub 110 at the air inlet 112. The fluid injection system can provide a heated flow of air and water to the tub 110 via the air inlet 112, so as to create bubbles within the tub at the one or more air injection orifices and provide a massaging effect on a user's body. The heated flow of air and water used to create the bubbles within the tub 110 can, advantageously, help to maintain an elevated temperature of the heated water contained in the tub for an extended period of time (e.g., within about 2.5 degrees over 20 minutes), as compared to conventional air bath systems, which typically cool very quickly (e.g., approximately 5 degrees over 20 minutes, etc.), due to the evaporative cooling effect of warm, dry air being added to the tub.

Figure 5:
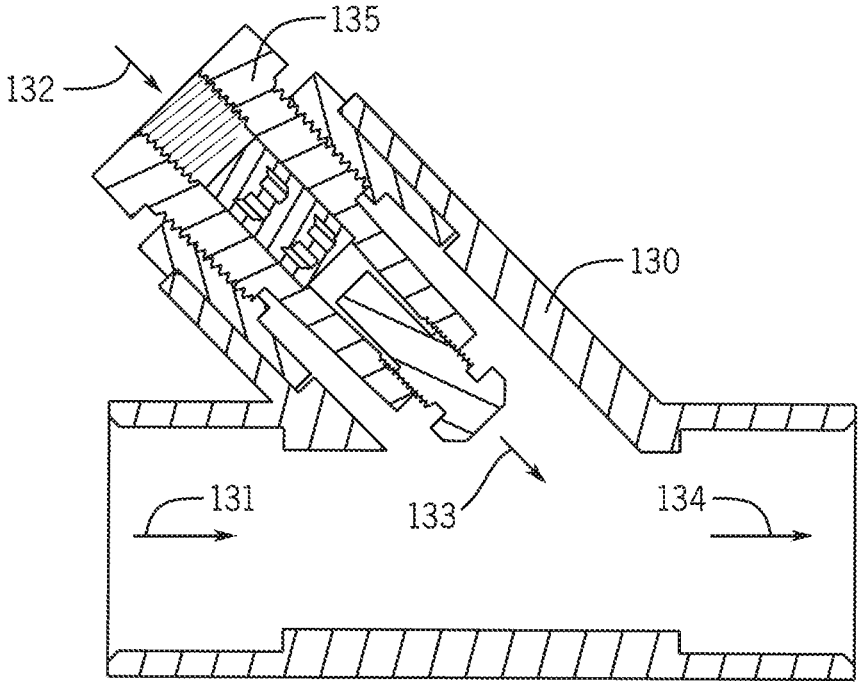
FIG. 5 is a cross-sectional view of a fluid injector and wye fitting for the bath system of FIG. 1, according to an exemplary embodiment.

Referring to the embodiment of FIGS. 1 and 5, a water source 140 is fluidly coupled to the fluid injector 135, and can provide a flow of water to the fluid injector 135 via a valve, shown as a solenoid valve 136. According to an exemplary embodiment, the water source 140 is a household hot water line located remotely from the tub 110. The water source 140 can be fluidly coupled to an inlet side of the solenoid valve 136 by a tee fitting. The outlet of the tee fitting can be fluidly coupled to a faucet for the tub 110. This configuration can, advantageously, allow for the water line leading to the solenoid valve 136 to be purged of cold water (or room temperature water) as the tub 110 is filled with water from the faucet, so as to provide hot water to the fluid injector 135 more quickly, as compared to conventional systems. According to other exemplary embodiments, the water source 140 is water that is present within the tub 110. In another embodiment, the valve can be connected directly to a household cold water inlet without the need for a tee fitting.

As shown in FIGS. 1 and 5, the fluid injector 135 is coupled to a fitting 130, shown as a wye fitting, at a first portion of the fitting. The fluid injector 135 can receive the flow of water from the water source 140, as generally indicated by arrow 132 in FIG. 5, and can provide an atomized spray of water through an interior of the fitting 130 in the direction indicated by arrow 133 in FIG. 5. Providing an atomized spray of water through the fitting 130 is particularly advantageous to achieve a more uniform mixture of air and water, as will be described in further detail in the paragraphs that follow. According to an exemplary embodiment, water can be provided by the water source 140 to the fluid injector 135 at a flow rate of about 2 gallons per hour (gph). This low flow rate is particularly advantageous to reduce the amount of water used by the system, while still maintaining a desired temperature of the water in the tub 110. According to other exemplary embodiments, the fitting 130 is another type of fitting or joint for combining two or more fluid flows together (e.g., air and water, etc.).

An air supply source 150 is fluidly coupled to the other branch of the fitting 130. The air supply source 150 can provide a flow of air to the fitting 130, as indicated generally by arrow 131 in FIG. 5. According to an exemplary embodiment, the air supply source 150 is a blower. The blower can include a pre-heater for pre-heating the flow of air before directing the flow of air to the fitting 130 upstream of the fluid injector 135, according to an exemplary embodiment. The flow of air provided by the air supply source 150 can be combined with the atomized spray of water provided by the fluid injector 135, so as to create a combined flow of air and water upstream of the conduit assembly 120, as indicated generally by arrow 134 in FIG. 5. The combined flow of air and water can flow downstream of the fitting 130 to the conduit assembly 120, where the combined flow can be heated and directed to the air inlet 112 on the tub 110. The air inlet 112 can direct the heated air/water mixture to the various air injection orifices located throughout the tub 110 to create bubbles and provide a massaging effect for a user.

Referring to FIGS. 2-6B, the conduit assembly 120 includes a case 121 having an inlet assembly 122*a* (e.g., inlet, inlet portion, etc.) for receiving the combined flow of air and water from the fitting 130, and an outlet assembly 122*b* (e.g., outlet, outlet portion, etc.) for directing the heated combined flow of air and water to the air inlet 112. The conduit assembly 120 further includes a conduit 125 disposed in the case 121 between the inlet 122*a* and the outlet 122*b*. The conduit 125 is configured to heat the combined flow of air and water, and to direct the heated combined flow from the inlet assembly 122*a* to the outlet assembly 122*b*.

Figure 3:
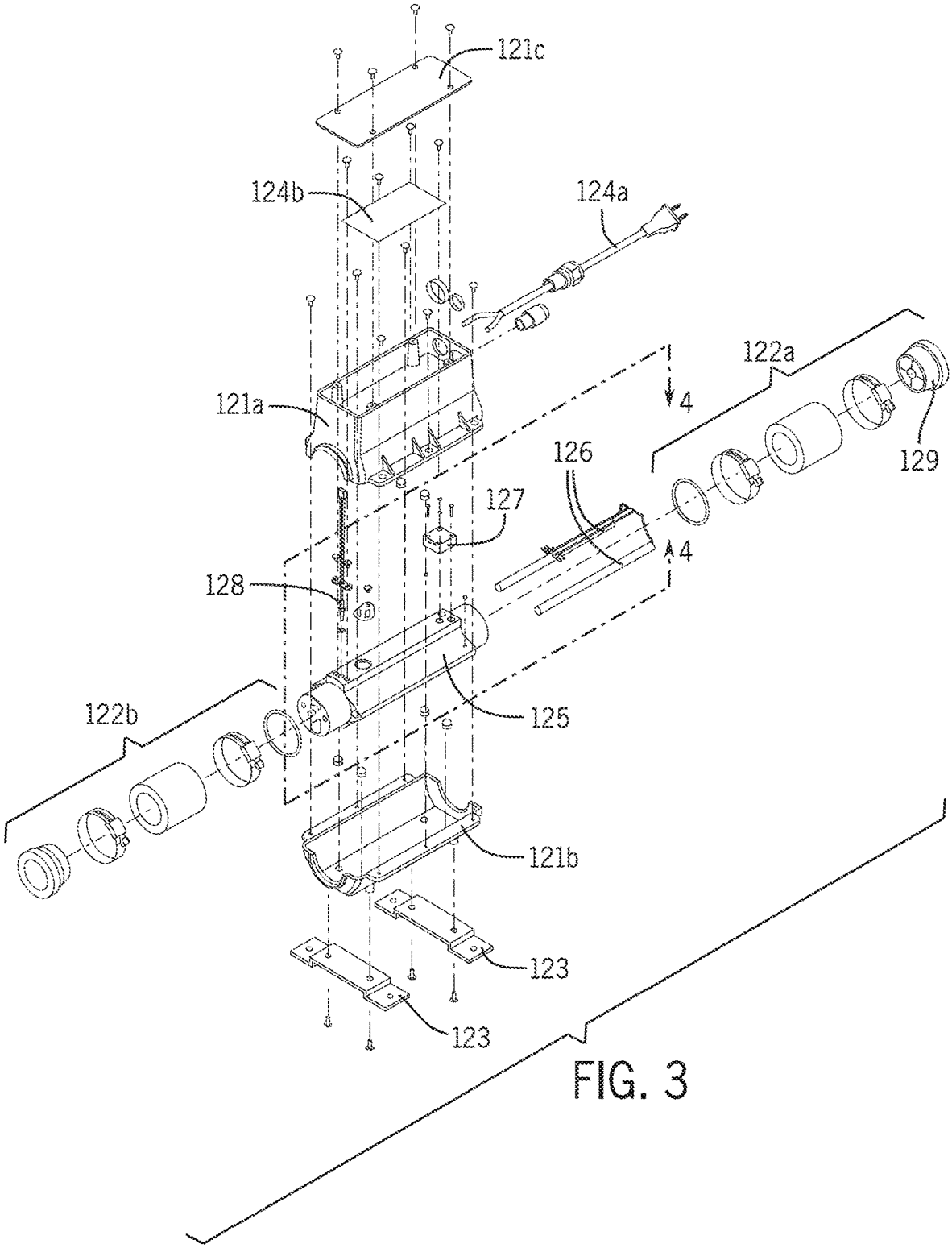
FIG. 3 is an exploded view of the conduit assembly of FIG. 2.
Figure 4:
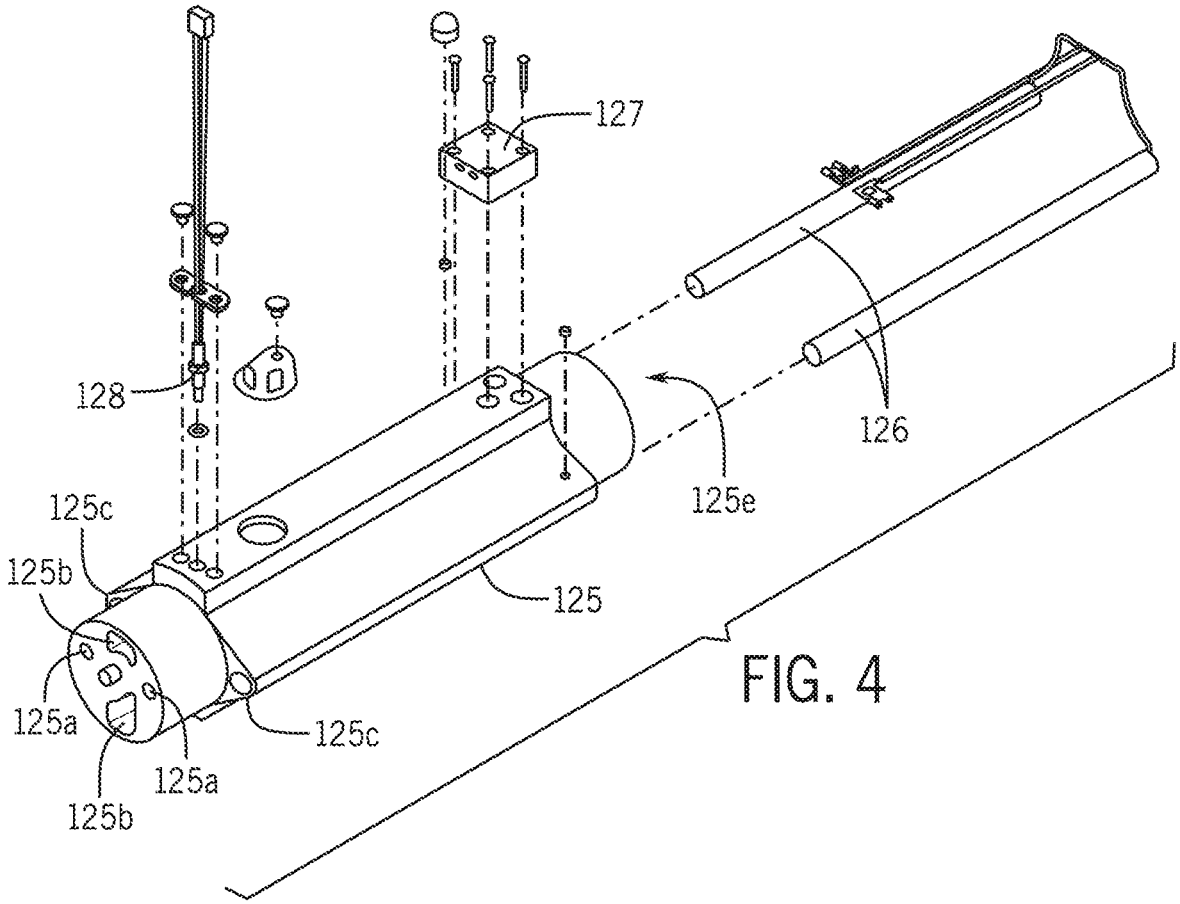
FIG. 4 is a detail view of the conduit assembly of FIG. 2.

As shown in FIG. 3, the case 121 includes an upper member 121*a* and a lower member 121*b* that are coupled together to define the case 121. According to other exemplary embodiments, the upper member 121*a* and the lower member 121*b* are integrally formed. According to the exemplary embodiment of FIG. 3, the conduit 125 is disposed between the upper member 121*a* and the lower member 121*b* in a lower cavity 121*b*'. The upper member 121*a* includes an upper cavity 121*a*' for receiving various electronic components of the conduit assembly 120 therein, such as a circuit board 124*b* and a power cord 124*a*. A cover 121*c* can be removably coupled to an upper portion of the upper member 121*a*, so as to provide access to the various electronic components contained in the upper cavity 121*a*'. The case 121 can also include one or more brackets 123 coupled to, or integrally formed with, the case 121 (e.g., upper member 121*a* and/or lower member 121*b*, etc.) for mounting the conduit assembly 120 to, for example, a side of the tub 110, as shown in the exemplary embodiment of FIG. 1.

Figure 6A:
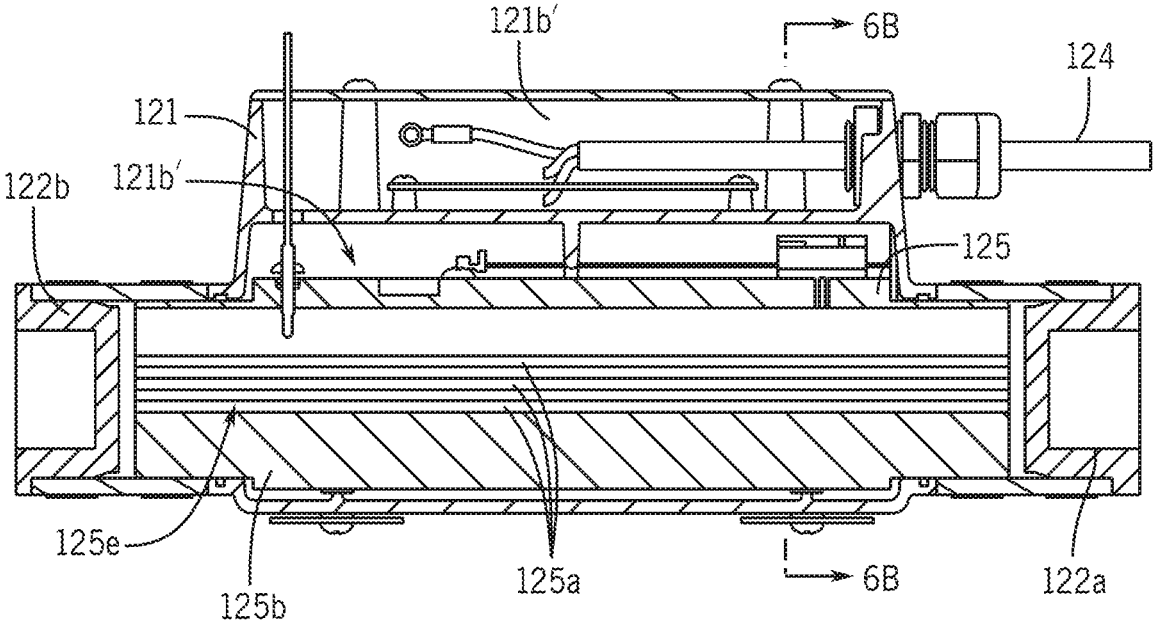
FIG. 6A is a cross-sectional view of the conduit assembly of FIG. 2 taken along line 6A-6A in FIG. 2.
Figure 6B:
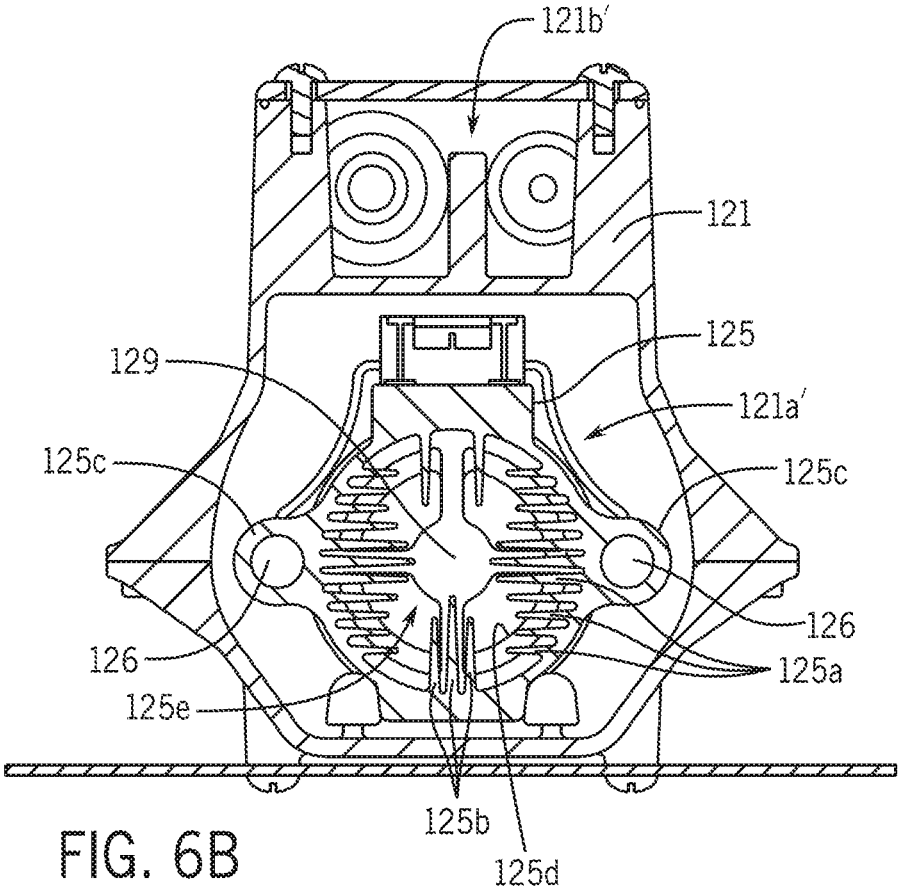
FIG. 6B is a cross-sectional view of the conduit assembly of FIG. 2 taken along line 6B-6B in FIG. 6A.

Referring to FIGS. 3-4 and 6A-6B, the conduit 125 has a generally cylindrical shape and includes a central opening 125*e* defined by an inner wall 125*d* and a plurality of fins (e.g., a first plurality of fins 125*a*, and a second plurality of fins 125*b*). The first plurality of fins 125*a* extend inwardly away from a first portion of the inner wall 125*d* of the conduit 125, and the second plurality of fins 125*b* extend inwardly away from a second portion of the inner wall 125*d* at an angle relative to the first plurality of fins 125*a*. As shown in FIG. 6B, the first plurality of fins 125*a* each extend inward toward an interior of the central opening 125*e* in a latitudinal direction to define a generally hour glass shaped opening. The second plurality of fins 125*b* each extend inward toward an interior of the central opening 125*e* in a longitudinal direction from upper and lower portions of the inner wall 125*d*. Thus, the central opening 125*e* does not have a cylindrical shape, but rather has a cross-sectional shape that is irregular and is defined by the surfaces of the first and second pluralities of fins 125*a*, 125*b* and the inner wall 125*d* of the conduit.

According to the exemplary embodiment shown, the second plurality of fins 125*b* are oriented substantially perpendicular to the first plurality of fins 125*a*. The first plurality of fins 125*a* and the second plurality of fins 125*b* extend continuously from each end of the conduit 125. According to an exemplary embodiment, each of the first plurality of fins 125*a* has a thickness of about 0.04" to about 0.09" and is spaced apart from adjacent fins by about 0.04" to about 0.12". Each of the second plurality of fins 125*b* has a thickness of about 0.04" to about 0.09" and is spaced apart from adjacent fins by about 0.04" to about 0.12". According to other exemplary embodiments, the first and second pluralities of fins 125*a*, 125*b* can have different thicknesses and relative spacing or orientations depending on the particular application of the conduit assembly. The first and second pluralities of fins 125*a*, 125*b* can, advantageously, direct heat energy from a heat source located external to the central opening 125*e*, through the inner wall 125*d* and into the central opening 125*e* via conduction. By locating the heat source external to the conduit interior, away from direct contact with the combined flow of air and water flowing therein, large temperature variations in the heat source can be reduced or eliminated, thus increasing the effectiveness and extending the useful life of the heat source. The first plurality of fins 125*a*, the second plurality of fins 125*b*, and the inner wall 125*d* of the conduit can each provide heat energy to the central opening 125*e* to heat a mixed flow of air and water flowing therein.

For example, in the exemplary embodiment of FIGS. 3-4 and 6A-6B, the conduit 125 includes a pair of side portions 125*c* (collectively referred to as an outer portion of the conduit) having openings for receiving a pair of heating elements 126. According to an exemplary embodiment, the heating elements 126 are resistive heating elements, such as Calrods, that are coupled to the conduit 125 in the side portions 125*c*. According to other exemplary embodiments, the heat source is another type of heat source capable of producing heat energy. The heating elements 126 can provide heat energy to the side portions 125*c* and to the inner wall 125*d* of the conduit 125 via conduction. The first and second pluralities of fins 125*a*, 125*b* and the inner wall 125*d* can, advantageously, cooperate to direct the heat energy from the heating elements 126 to the central opening 125*e* via conduction, so as to heat the combined flow of air and water flowing through the central opening 125*e*.

Still referring to the embodiment of FIGS. 3 and 6B, the inlet assembly 122*a* and the outlet assembly 122*b* can each include an adapter 129 for fluidly coupling additional conduit sections to the conduit assembly 120 (e.g., conduit sections 141, 142). As shown in FIGS. 3 and 6B, the adapter 129 can include a flow distributor defined by an internal cross-shaped structure and a protrusion located at a center of the cross-shaped structure. According to other exemplary embodiments, the flow distributor 129 is coupled directly at the inlet of the conduit 125. The flow distributor can, advantageously, help to direct the mixed flow of air and water outwardly away from the center of the central opening 125*e* toward the fins 125*a*, 125*b* and the inner wall 125*d* of the conduit 125, such that the mixed flow of air and water is more evenly heated. Accordingly, it is particularly advantageous to include an adapter 129 with at least the inlet assembly 122*a* before the combined flow of air and water is heated through the conduit 125.

The conduit assembly 120 can further include a temperature sensor, shown as a thermistor 128, disposed through a portion of the conduit 125 in the central opening 125*e*, as shown in the embodiment of FIG. 6A. According to other exemplary embodiments, the thermistor is another type of temperature sensor capable of providing temperature data from the central opening 125*e*. The thermistor 128 can provide temperature data regarding a combined flow of air and water through the central opening 125*e*, so as to selectively control the heat source of the conduit 125 (e.g., heating elements 126). As shown in the embodiment of FIG. 6A, the thermistor 128 is disposed closer to the outlet 125*b*, so as to provide temperature data regarding the heated air/water mixture leaving the conduit 125. For example, the conduit assembly 120 can include a controller disposed in, for example, the upper cavity 121*b*' of the case 121. The controller can receive data from the thermistor 128 regarding a temperature of a mixed flow of air and water flowing through the conduit 125. The controller can determine whether to operate the heat source based on a current temperature of the mixed flow leaving the conduit 125 near the outlet assembly 122*b*, so as to achieve a desired air/water temperature at the air inlet 112 of the tub 110. According to other exemplary embodiments, the thermistor 128 can be replaced with a mechanical thermostat or other types of temperature sensors and control systems. According to other exemplary embodiments, the heating elements may be sized appropriately for the volume of air provided by the air supply source (e.g., blower, etc.), so as to eliminate the need for the thermistor 128 (or other temperature sensor).

As shown in the embodiment of FIGS. 3-4 and 6A-6B, a pressure switch 127 is disposed through a portion of the conduit 125 into the central opening 125*e*. The pressure switch 127 can, advantageously, ensure that the heat source (e.g., heating elements 126) is not operated unless a mixed flow of air and water is passing through the central opening 125*e* of the conduit. For example, the pressure switch 127 and the heating elements 126 can each be operatively coupled to the controller. The controller can receive data from the pressure switch 127 regarding an ambient pressure within the central opening 125*e*. The controller can determine whether or not to operate the heating elements 126 based on the data received from the pressure switch 127.

According to another exemplary embodiment, the tub 110 includes one or more sensors 111 for detecting a water level within the tub. The sensors 111 can be coupled to an interior portion of the tub 110, and can be operatively coupled to the controller. In response to a detected water level in the tub 110 by the sensors 111, the controller can operate the heat source (e.g., heating elements 126), so as to pre-heat the conduit 125 as the tub 110 is being filled with water. The air supply source 150 can be selectively operated by a user once the water level in the tub 110 reaches a desired level. In this manner, the time required for the bubbles produced by the system to feel warm to a user is significantly reduced.

The heated flow of air and water provided by the conduit assembly 120 to create the bubbles within the tub 110 can, advantageously, help to maintain an elevated temperature of the heated water contained in the tub for an extended period of time (e.g., about 2.5 degrees over 20 minutes), as compared to conventional air bath systems, which typically cool very quickly (e.g., approximately 5 degrees over 20 minutes, etc.), due to the evaporative cooling effect of warm dry air being added to the tub.

Figure 7:
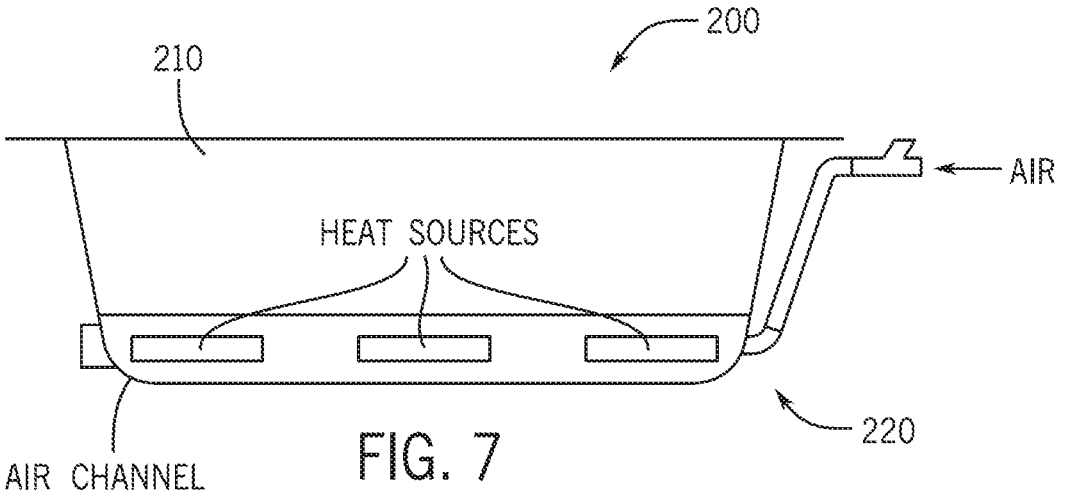
FIGS. 7-14 are schematic views of various bath systems according to other exemplary embodiments.

Referring to FIG. 7, an air bath system 200 is shown according to another exemplary embodiment. The air bath system 200 includes a fluid injection system 220 coupled to a tub 210. In this exemplary embodiment, one or more heat sources, shown as a plurality of resistive heating elements, are coupled directly to an outer portion of the structure defining an air channel for the tub 210. According to various exemplary embodiments, the air channel structure is coupled to, or integrally formed with, the tub 210, such as along a bottom portion of the tub. A mixed flow of air and water can be provided by the fluid injection system 220, which includes a fitting and a fluid injector fluidly coupled to an air supply source (e.g., a blower, etc.) and a water supply source (e.g., a household water line, etc.), respectively, similar to the configuration illustrated in the embodiment of FIG. 1. According to the embodiment shown, the mixed flow of air and water can be directed to an interior of the air channel where the mixed flow is heated within the air channel by the plurality of heating elements coupled to the outer portion of the air channel structure.

Figure 8:
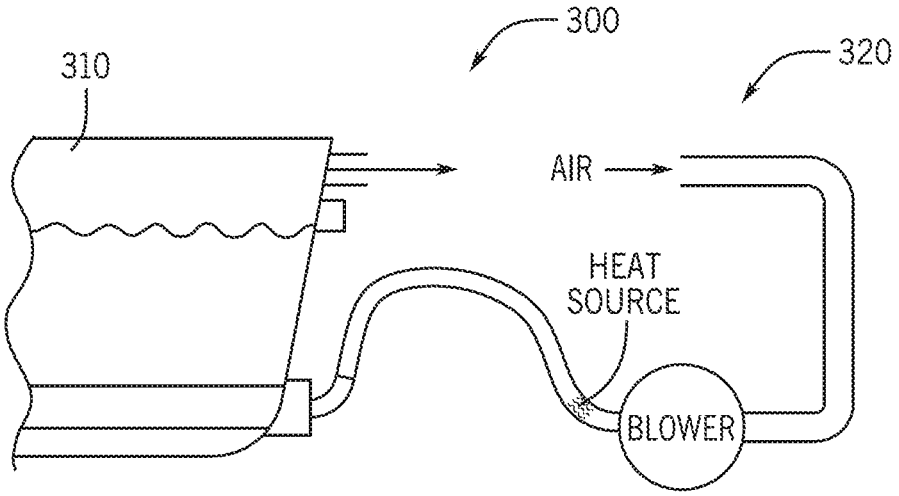

Referring to FIG. 8, an air bath system 300 is shown according to another exemplary embodiment. The air bath system 300 includes a fluid injection system 320 coupled to a tub 310. In this exemplary embodiment, air is supplied to a blower from an inlet located above a bath overflow on the tub 110 near the surface of the warm water in the tub, such that the air supplied to the blower has an increased temperature and humidity level. A heat source, shown as resistive heating elements, is coupled within a conduit section between the blower and an air inlet on the tub 210. The heating elements can heat the humid air flow directed by the blower to the air inlet on the tub 210 for creating bubbles within the tub.

Figure 9:
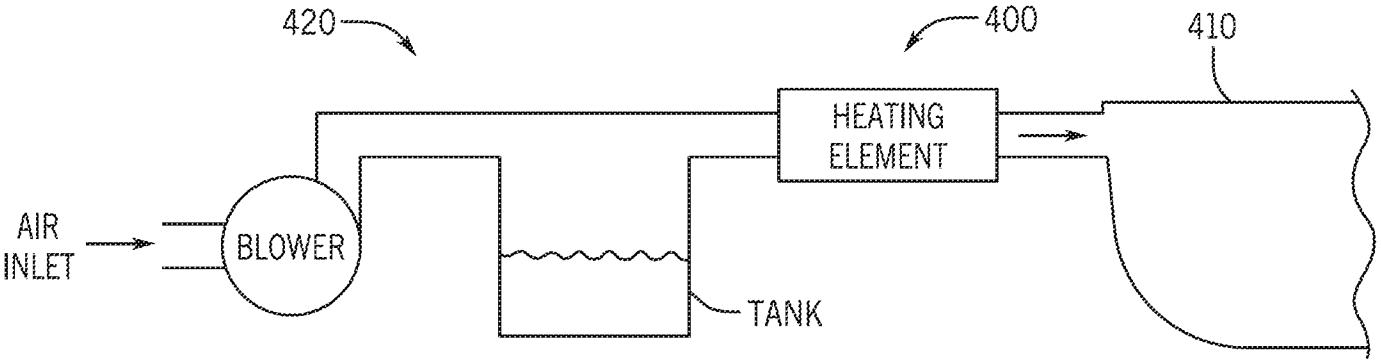

Referring to FIG. 9, an air bath system 400 is shown according to another exemplary embodiment. The air bath system 400 includes a fluid injection system 420 coupled to a tub 410. In this exemplary embodiment, the fluid injection system 420 includes a tank including a volume of warm water disposed between a blower and a heat source (e.g., a heating element, etc.). The blower can receive a flow of air from ambient, and direct the flow of air across/above the warm water present within the tank. The flow of air can absorb at least a portion of the evaporated warm water from the tank to increase the relative humidity of the flow of air before being directed toward the heat source. The heat source can heat the humid air flow before being introduced into the tub 410.

Figure 10:
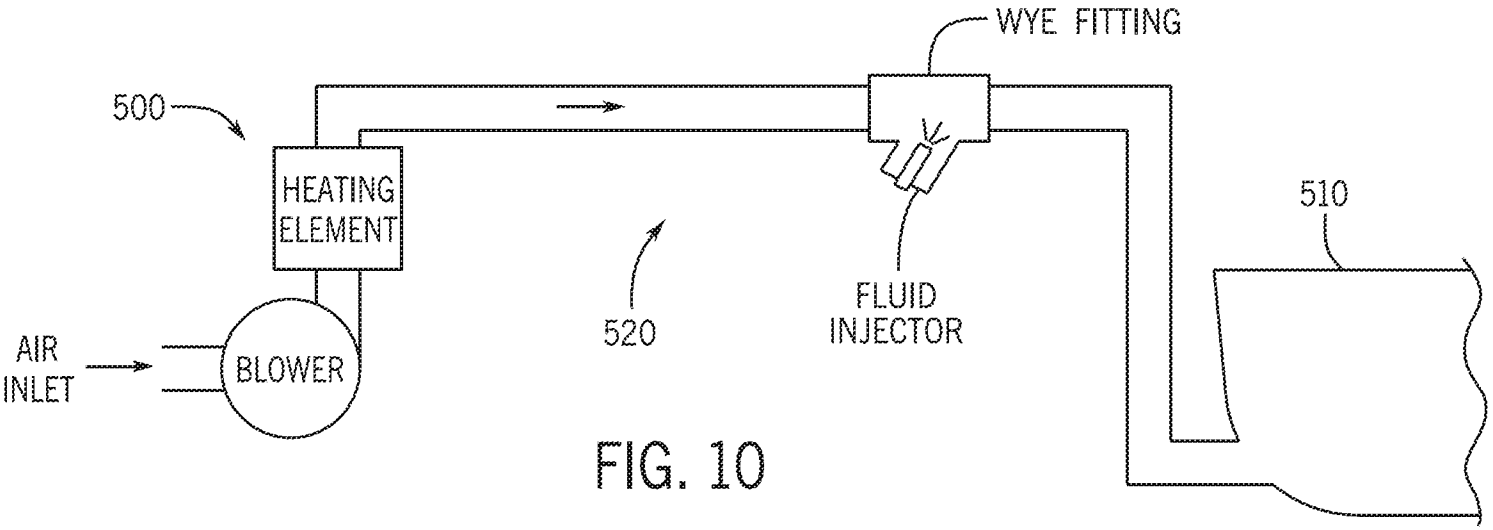

Referring to FIG. 10, an air bath system 500 is shown according to another exemplary embodiment. The air bath system 500 includes a fluid injection system 520 coupled to a tub 510. In this exemplary embodiment, the fluid injection system 520 includes a blower, a heat source (e.g., a heating element, etc.) disposed downstream of the blower, and a fluid injector shown as a misting nozzle. The blower can direct a flow of air past the heat source to heat the air flow. The heated air flow can be directed through, for example, a wye fitting that includes a fluid injector fluidly coupled to a water supply source, such as a household water line. The fluid injector can provide an atomized spray of water through the wye fitting to mix with the heated air flow. Evaporative cooling can cause the atomized spray of water to cool and humidify the heated air flow to a desired level before being introduced into the tub 510.

Figure 11:
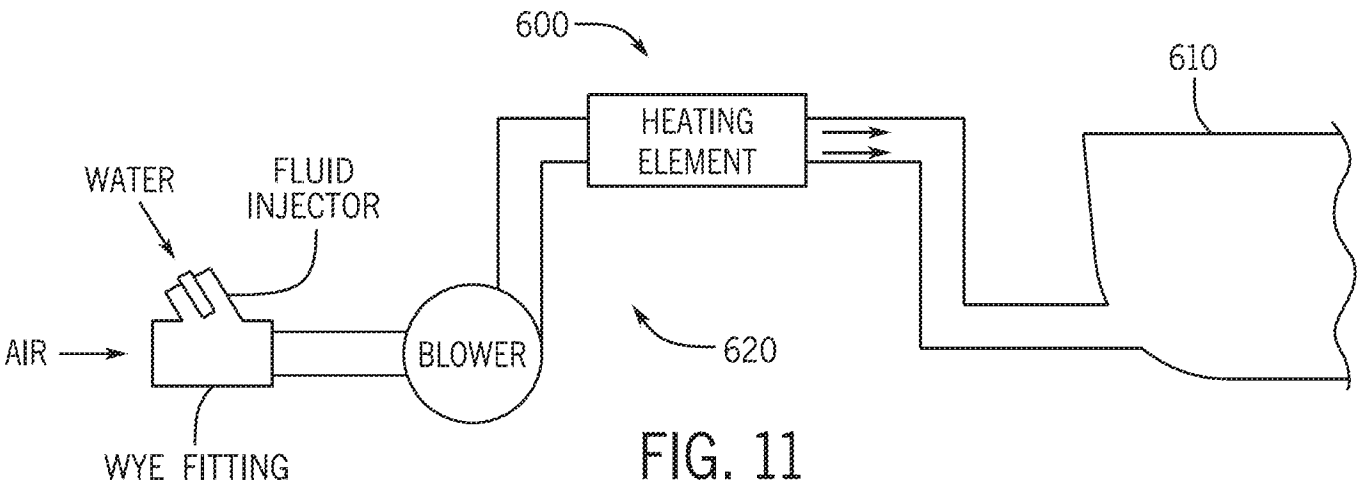

Referring to FIG. 11, an air bath system 600 is shown according to another exemplary embodiment. The air bath system 600 includes a fluid injection system 620 coupled to a tub 610. In this exemplary embodiment, the air/water injection system 620 includes a fluid injector fluidly coupled to a water supply source (e.g., a household water line, etc.), a water-resistant blower located downstream of the fluid injector, and a heat source (e.g., a heating element, etc.) disposed downstream of the blower. The fluid injector is coupled to a wye fitting and is configured to introduce an atomized spray of water into the wye fitting. The wye fitting also includes a portion for receiving a flow of air from ambient, such that the atomized spray of water can mix with the flow of air downstream of the wye fitting. The water-resistant blower can direct the mixed flow of air and water from the wye fitting to the heat source where the mixed flow can be heated before being introduced into the tub 610.

Figure 12:
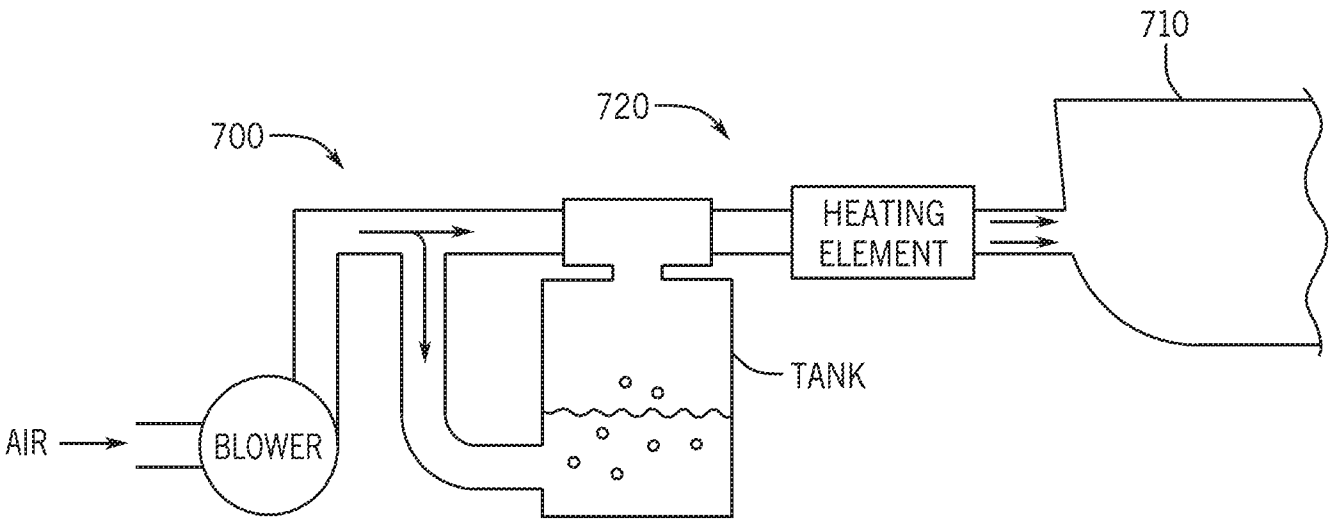

Referring to FIG. 12, an air bath system 700 is shown according to another exemplary embodiment. The air bath system 700 includes a fluid injection system 720 coupled to a tub 710. In this exemplary embodiment, the fluid injection system 720 includes a blower, a tank including a volume of water located downstream of the blower, and a heat source (e.g., a heating element, etc.) located downstream of the tank. A lower portion of the tank is fluidly coupled to a first conduit located downstream of the blower via a second conduit. The second conduit can meter a portion of the flow of air from the blower and can direct the flow of air into the volume of water in the tank to create bubbles therein. The bubbles can cause moisture in the tank to rise and mix with the remaining portion of the flow of air flowing through the first conduit above the tank to thereby raise the relative humidity of the flow of air. The humid air flow can flow past the heat source to heat the humid air flow before being introduced into the tub 710.

Figure 13:
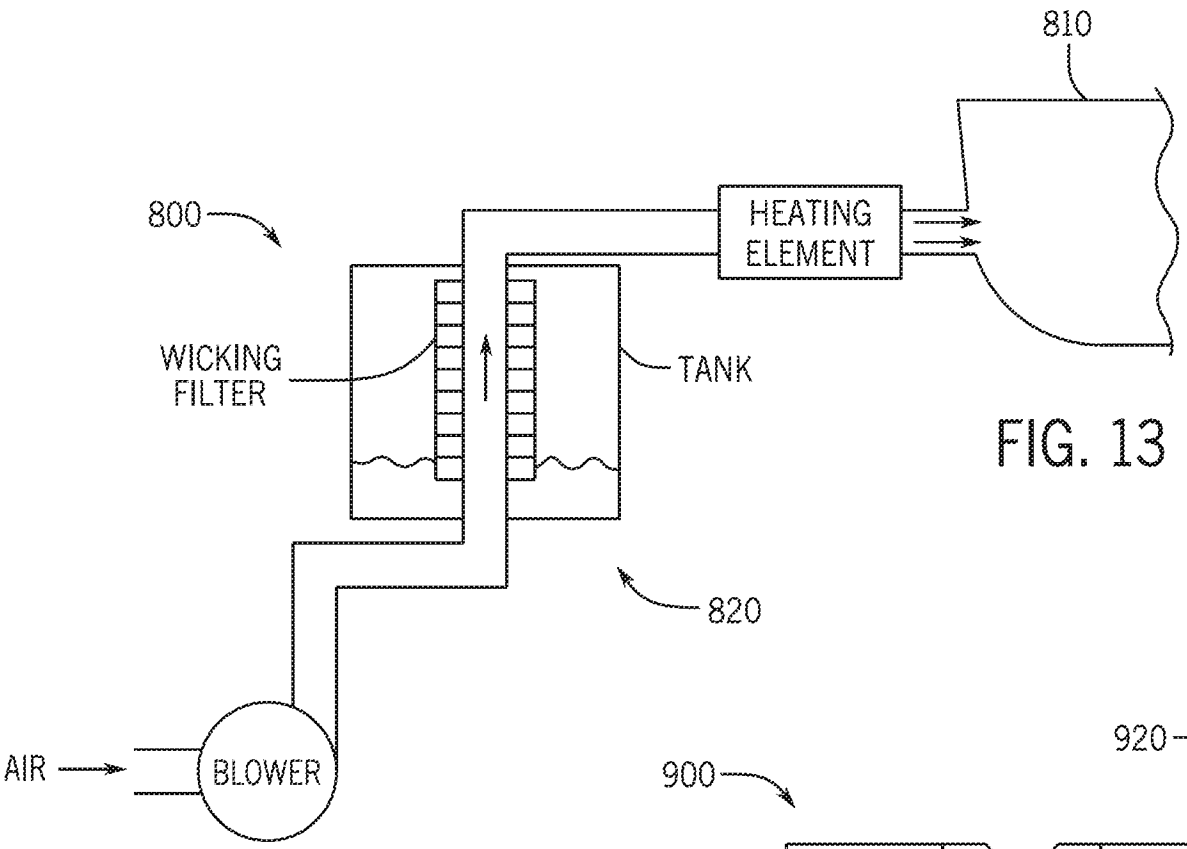

Referring to FIG. 13, an air bath system 800 is shown according to another exemplary embodiment. The air bath system 800 includes a fluid injection system 820 coupled to a tub 810. In this exemplary embodiment, the fluid injection system 820 includes a blower, a tank located downstream of the blower, and a heat source (e.g., a heating element, etc.) located downstream of the tank. The tank includes a conduit section disposed between an upper portion and a lower portion of the tank. The conduit section is defined by a wicking filter that can absorb at least a portion of a volume of water present within the tank (e.g., water received from a water source, such as a household water line), such that a flow of air passing through the conduit section can absorb water from the filter and increase the relative humidity of the flow of air. The blower is fluidly coupled to the lower portion of the tank, and can introduce a flow of air into the tank and the wicking filter. The humid air flow can pass from the tank to the heat source to heat the humid air flow before being introduced into the tub 810.

Figure 14:
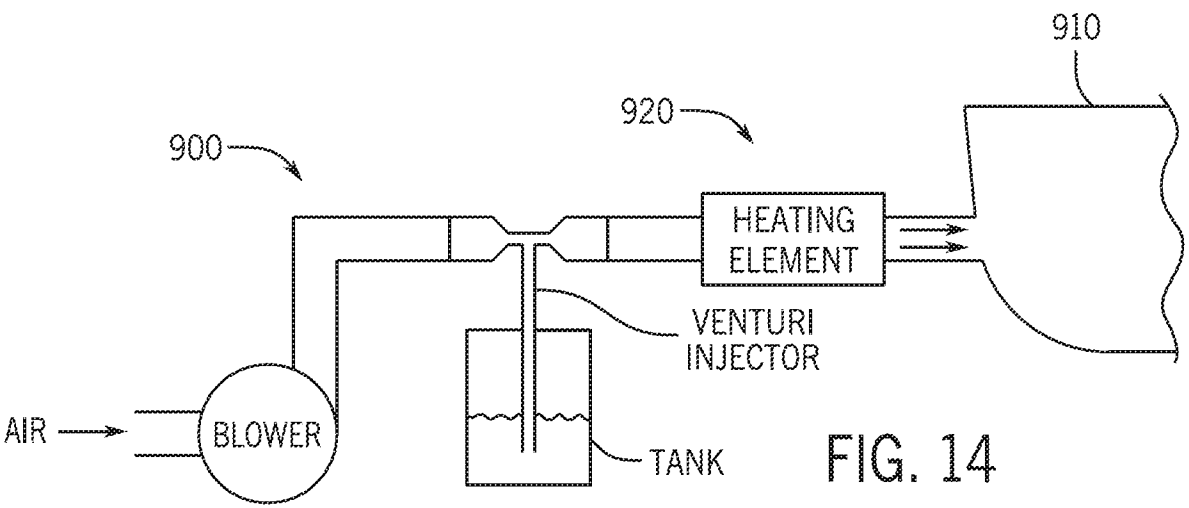

Referring to FIG. 14, an air bath system 900 is shown according to another exemplary embodiment. The air bath system 900 includes a fluid injection system 920 coupled to a tub 910. In this exemplary embodiment, the fluid injection system 820 includes a blower, a venturi injector located downstream of the blower, a water tank, and a heat source (e.g., a heating element, etc.) located downstream of the venturi injector and water tank. The water tank includes a volume of water therein and is fluidly coupled to the venturi injector via a tank conduit at a T-shaped joint on the injector. The blower can provide a flow of air through a primary conduit to the venturi injector where the flow of air is constricted through the injector to reduce the fluid pressure at the T-shaped joint of the tank conduit. This lower pressure causes water in the tank to be sucked up through the tank conduit to the air flow passing through the venturi injector to thereby create a mixed flow of air and water. The mixed flow of air and water can pass from the venturi injector to the heat source to heat the mixed flow before being introduced into the tub 910.

The disclosed fluid injection systems can provide a heated flow of air and water to create bubbles within a tub, which can, advantageously, help to maintain an elevated temperature of the heated water contained in the tub for an extended period of time (e.g., about 2.5 degrees over 20 minutes), as compared to conventional air bath systems, which typically cool very quickly (e.g., approximately 5 degrees over 20 minutes, etc.), due to the evaporative cooling effect of warm dry air being added to the tub.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the application as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the apparatus as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments.

Other substitutions, modifications, changes and omissions may also be made in the design, operating conditions and arrangement of the various exemplary embodiments without departing from the scope of the present application. For example, any element disclosed in one embodiment may be incorporated or utilized with any other embodiment disclosed herein.

What is claimed is:

1. A bath system, comprising:

a tub having a jet orifice; and a fluid injection system fluidly coupled to the jet orifice, the fluid injection system comprising:

a conduit having an opening;

a heat source coupled to an outer portion of the conduit external to the opening;

an air supply source fluidly coupled to the conduit, the air supply source configured to provide a flow of air to the opening; and a fluid injector configured to provide water to the flow of air to produce a combined flow of air and water;

wherein the heat source and the conduit are cooperatively configured to heat the combined flow of air and water in the opening before the combined flow enters the tub through the jet orifice;

wherein the conduit includes a plurality of fins extending inwardly away from an inner wall of the conduit toward an interior of the conduit; and wherein the heat source is configured to provide heat energy through the outer portion of the conduit to the inner wall and to the plurality of fins of the conduit by conduction so as to heat the combined flow of air and water in the opening.

2. The bath system of claim 1, wherein the fluid injector is configured to receive a flow of water from a household water line at a flow rate of about 2 gallons per hour.

3. The bath system of claim 1, wherein the heat source is configured to provide heat energy to the conduit in response to a detected water level in the tub as the tub is being filled with water, so as to pre-heat the conduit before receiving the combined flow of air and water.

4. The bath system of claim 1, wherein the fluid injector is configured to receive a flow of water from a household hot water line that is also used to fill the tub.

5. The bath system of claim 1, wherein the opening has an irregular shape defined by surfaces of the plurality of fins and the inner wall.

6. The bath system of claim 1, wherein the plurality of fins includes a first plurality of fins and a second plurality of fins, wherein the first plurality of fins are oriented at an angle relative to the second plurality of fins.

7. The bath system of claim 1, wherein the heat source comprises a resistive heating element coupled to the outer portion of the conduit.

8. The bath system of claim 1, wherein the conduit includes an inlet configured to receive the combined flow of air and water and an outlet configured to direct a heated combined flow of air and water to the tub, and wherein the inlet includes a flow distributor configured to direct the combined flow of air and water outwardly away from a center of the opening toward the plurality of fins and the inner wall.

9. A fluid injection system for a bathtub, the fluid injection system comprising:

a conduit having an inlet, an outlet, and an opening extending between the inlet and the outlet;

a heat source coupled to an outer portion of the conduit external to the opening;

an air supply source fluidly coupled to the conduit upstream from the inlet, the air supply source configured to provide a flow of air to the opening; and a fluid injector fluidly coupled to the conduit upstream from the inlet and downstream from the air supply source, the fluid injector configured to provide water to the flow of air to produce a combined flow of air and water;

wherein the heat source and the conduit are cooperatively configured to heat the combined flow of air and water in the opening before directing the combined flow to a jet orifice of the bathtub; and wherein the inlet includes a flow distributor configured to direct the combined flow of air and water outwardly away from a center of the opening toward an inner wall of the conduit.

10. The fluid injection system of claim 9, wherein the fluid injector is configured to receive a flow of water from a household water line at a flow rate of about 2 gallons per hour.

11. The fluid injection system of claim 9, wherein the heat source is configured to provide heat energy to the conduit in response to a detected water level in the bathtub as the bathtub is being filled with water, so as to pre-heat the conduit before receiving the combined flow of air and water.

12. The fluid injection system of claim 9, wherein the fluid injector is configured to receive a flow of water from a household hot water line that is also used to fill the bathtub.

13. The fluid injection system of claim 9, wherein the conduit includes a plurality of fins extending inwardly away from an inner wall of the conduit toward an interior of the conduit.

14. A fluid injection system for a bathtub, the fluid injection system comprising:

a conduit defining an opening;

a blower fluidly coupled to the conduit, the blower configured to direct a flow of air through the opening;

a water source in fluid communication with the conduit, the water source configured to provide water to the flow of air to produce a combined flow of air and water; and a heat source configured to provide heat energy to the combined flow of air and water before the combined flow enters the bathtub to produce bubbles;

wherein the water source includes a tank having a volume of water, the tank located between the blower and the heat source, and wherein the flow of air is directed past the volume of water to absorb at least a portion of evaporataed water from the tank.

15. The fluid injection system of claim 14, wherein the heat source includes a plurality of resistive heating elements configured to be coupled directly to an air channel structure disposed along a lower portion of the bathtub.

16. The fluid injection system of claim 14, wherein the blower is configured to receive the flow of air from an inlet located above an overflow on the bathtub, such that the flow of air is heated and humidified by water located in the bathtub.

17. The fluid injection system of claim 14, wherein the volume of water in the tank is heated, and wherein the flow of air is directed across the volume of heated water to absorb at least a portion of evaporated water from the tank.

18. The fluid injection system of claim 14, wherein the conduit is a first conduit, and wherein a lower portion of the tank is fluidly coupled to the first conduit upstream of the tank by a second conduit, such that the second conduit can meter at least a portion of the flow of air into the volume of water to create bubbles.

19. The fluid injection system of claim 14, wherein the tank is fluidly coupled to the conduit by a venturi injector.

20. The fluid injection system of claim 19, wherein the tank includes a wicking filter in fluid communication with the conduit, such that the flow of air can absorb water from the wicking filter.

21. The bath system of claim 1, wherein the fluid injector is coupled to a wye fitting, wherein the air supply source is fluidly coupled to the wye fitting, and wherein the fluid injector is configured to provide an atomized spray of water into the wye fitting for mixing with the flow of air.

22. The fluid injection system of claim 21, wherein the blower is a water-resistant blower, and wherein the wye fitting is located upstream of the blower.

* * * * *